United States Patent [19]

Weeks, Jr.

[11] Patent Number: 4,844,265

[45] Date of Patent: Jul. 4, 1989

[54] MODULAR SUSPENDED RACK

[76] Inventor: Edwin S. Weeks, Jr., 101 Thomas Ave., Riverton, N.J. 08077

[21] Appl. No.: 94,212

[22] Filed: Sep. 8, 1987

[51] Int. Cl.[4] ..... A47F 7/00

[52] U.S. Cl. ..... 211/60.1; 211/188; 211/59.4; 211/113

[58] Field of Search ..... 211/63, 64, 68, 70.2, 211/70.5, 70.8, 188, 119, 59.4, 113, 60.1; 248/558, 316.8, 201, 239, 234, 249; 108/91; 403/393, 396, 306

[56] References Cited

U.S. PATENT DOCUMENTS

| | | | |
|---|---|---|---|
| 680,450 | 8/1901 | Aiken | 211/181 X |
| 906,894 | 12/1908 | Kevorkian | 211/181 X |
| 928,195 | 7/1909 | Henderson | 211/119 |
| 2,511,160 | 6/1950 | Grobowski | 403/306 X |
| 2,535,564 | 12/1950 | Campbell | 211/64 X |
| 2,554,015 | 5/1951 | Costello | 403/396 |
| 3,288,417 | 11/1966 | Wallace | 248/317 |
| 3,527,354 | 9/1970 | Sokolow | 211/70.5 |
| 3,617,078 | 11/1971 | Valukonis | 403/396 X |
| 3,968,881 | 7/1976 | Beil et al. | 211/133 X |
| 4,271,997 | 6/1981 | Michael | 211/70.5 X |
| 4,456,125 | 6/1984 | Chap | 211/119 X |

FOREIGN PATENT DOCUMENTS

| | | | |
|---|---|---|---|
| 1107784 | 8/1955 | France | 248/318 |
| 7529103 | 1/1976 | Netherlands | 211/119 |

*Primary Examiner*—Ramon O. Ramirez
*Assistant Examiner*—Karen J. Chotkowski

[57] ABSTRACT

A suspended rack that will support long narrow objects in such a way that they can be removed in a direction perpendicular to their longitudinal axis. These racks can be joined in a vertical array thereby providing a plurality of storage spaces.

9 Claims, 1 Drawing Sheet

MODULAR SUSPENDED RACK

BACKGROUND OF THE INVENTION

The present invention relates to suspended storage racks that can be used in pairs to store long narrow objects such as sculls in such a way that they can be placed on the rack and removed from the rack in a direction perpendicular to their longitudinal axis without modifying the rack in any way.

Present practice is to store these long narrow rowing boats in suspended slings which are deficient in several ways including:

1. They must be modified (opened) to put the scull in storage or to remove the scull from storage.

2. When they are joined in a vertical array, a scull cannot be removed without first removing all sculls below. As a result they are used singly and do not make use of all available space in a boathouse.

DESCRIPTION OF THE PREFERRED EMBODIMENT

Figure 1:
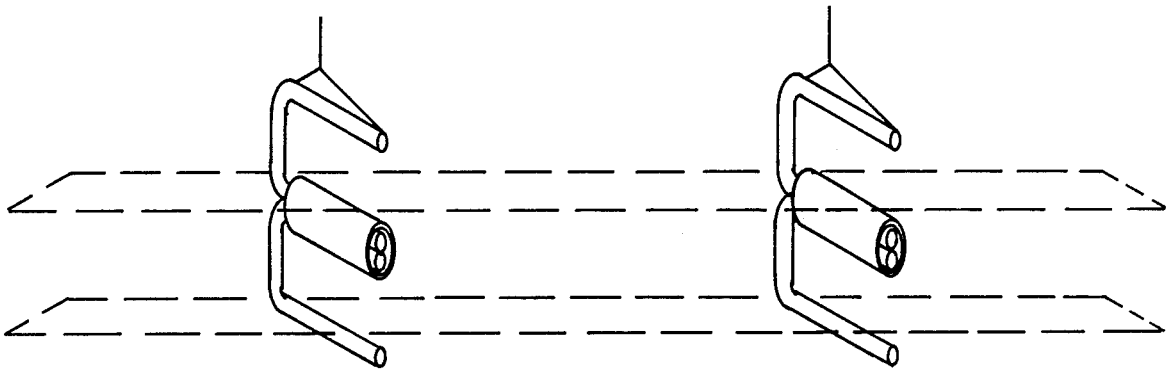
FIG. 1 is a perspective view of the preferred embodiment of the rack system with two boat hulls mounted thereon as shown in broken lines.
Figure 2:
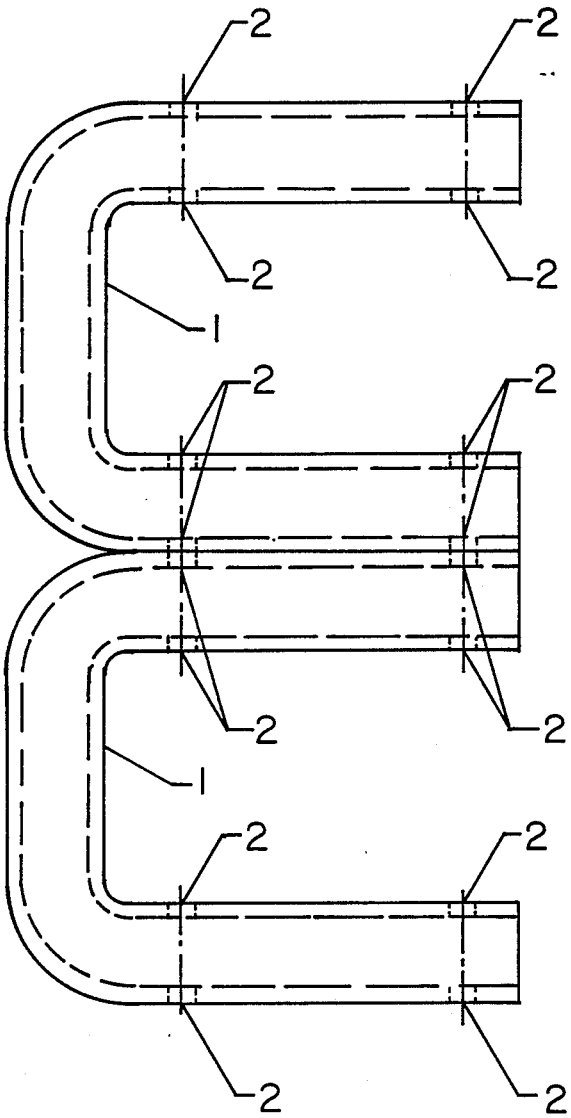
FIG. 2 is an enlarged view of two modules joined together.
Figure 2B:
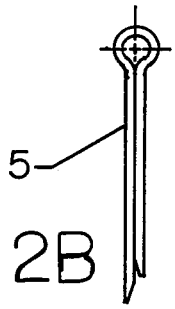
FIG. 2*b* is an enlarged detail view of a pin.
Figure 2A:
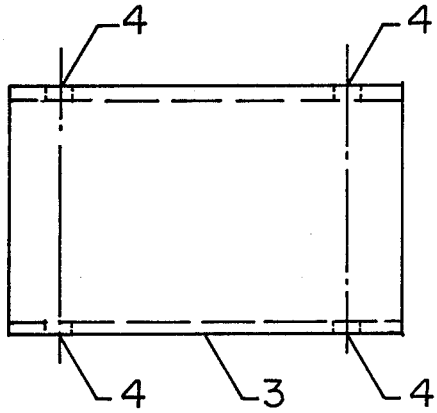
FIG. 2*a* is an enlarged view of a larger diameter piece of tubing.

Referring to the drawings, this invention is comprised of lengths of tubing formed into C shaped modules. These are designated 1 in the drawing. They have holes 2 thru the distal and proximal ends of the legs. A larger diameter piece of tubing 3 is used to join these modules. This piece of tubing 3 has a hole 4 located near each end so that a pin 5 can be inserted to prevent the three pieces from being accidentally disassembled.

I claim:

1. A pair of horrizontally disposed elements comprising at least two generally identical C shaped modules each having:

two legs with first apertures;

legs juxtaposed with first apertures aligned;

a sleeve with second apertures over said two juxtaposed legs and first and second apertures aligned;

a pin means in first and second aligned apertures;

support means to attach elements to support surface.

2. The device as recited in claim 1 comprising C shaped modules constructed of tubing of generally circular cross section.

3. The device as recited in claim 1 comprising C shaped modules constructed of tubing of generally rectangular cross section.

4. The device as recited in claim 1 comprising C shaped modules constructed of solid bar of generally round cross section.

5. The device as recited in claim 1 comprising C shaped modules constructed of solid bar of generally rectangular cross section.

6. The device as recited in claim 1 comprising C shaped modules constructed of structural shape beams.

7. The device as recited in claim 1 comprising at least one rigid member joining adjacent C shaped modules.

8. The device as recited in claim 1 wherein said support comprises an elongate pliable support comprises.

9. The device as recited in claim 1 wherein said support means comprises a rigid support means.

* * * * *